US010807359B2

(12) United States Patent
Hurst et al.

(10) Patent No.: US 10,807,359 B2
(45) Date of Patent: Oct. 20, 2020

(54) DROPLET-DEPOSITION APPARATUS AND METHODS OF DRIVING THEREOF

(71) Applicant: Xaar Technology Limited, Cambridge (GB)

(72) Inventors: Ian Anthony Hurst, Wilburton (GB); Neil Christopher Bird, Cambridge (GB); Stephen Mark Jeapes, Cambridge (GB)

(73) Assignee: XAAR TECHNOLOGY LIMITED, Cambridge (GB)

( * ) Notice: Subject to any disclaimer, the term of this patent is extended or adjusted under 35 U.S.C. 154(b) by 0 days.

(21) Appl. No.: 16/064,490

(22) PCT Filed: Dec. 21, 2016

(86) PCT No.: PCT/GB2016/054027
§ 371 (c)(1),
(2) Date: Jun. 21, 2018

(87) PCT Pub. No.: WO2017/109493
PCT Pub. Date: Jun. 29, 2017

(65) Prior Publication Data

US 2019/0001665 A1 Jan. 3, 2019

(30) Foreign Application Priority Data

Dec. 21, 2015 (GB) ..... 1522543.6

(51) Int. Cl.
*B41J 29/38* (2006.01)
*B41J 2/045* (2006.01)

(52) U.S. Cl.
CPC ..... *B41J 2/04536* (2013.01); *B41J 2/04581* (2013.01); *B41J 2/04588* (2013.01); *B41J 2/04596* (2013.01)

(58) Field of Classification Search
None
See application file for complete search history.

(56) References Cited

U.S. PATENT DOCUMENTS 5,329,293 A 7/1994 Liker
6,357,846 B1 3/2002 Kitahara
(Continued)

FOREIGN PATENT DOCUMENTS

EP 1174266 1/2002
EP 1795356 6/2007
(Continued)

OTHER PUBLICATIONS

International Preliminary Report on Patentability; PCT/GB16/064027, dated Jul. 5, 2018.
(Continued)

*Primary Examiner* — Matthew Luu
*Assistant Examiner* — Tracey M McMillion
(74) *Attorney, Agent, or Firm* — Finnegan, Henderson, Farabow, Garrett & Dunner LLP

(57) ABSTRACT

There is provided a droplet deposition apparatus comprising: control circuitry configured to generate a common drive waveform; storage to store data, wherein the storage comprises a buffer to store scheduled image data relating to one or more pixels; a droplet deposition head having one or more actuator elements configured to be driven in response to drive pulses derived from the common drive waveform; and wherein the common drive waveform comprises a plurality of pixel periods comprising a firing phase and a non-firing phase, each firing phase comprising a firing pulse and each non-firing phase comprising a non-firing pulse, wherein the characteristics of each non-firing pulse are defined in response to the data in storage, and wherein, the firing pulse of a first pixel period is applied as a drive pulse to an actuator
(Continued)

Figure 1:
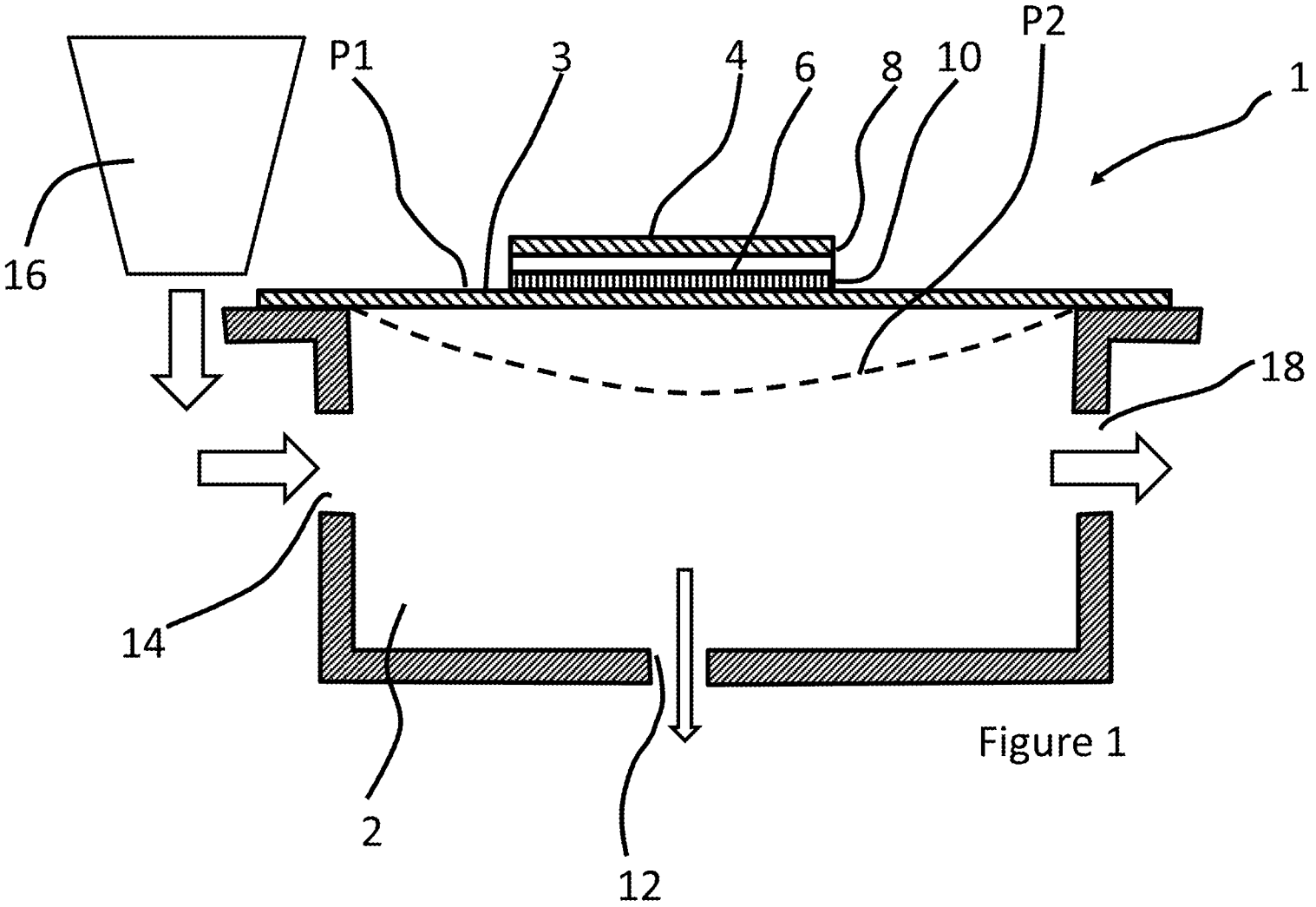

element based on the scheduled image data relating to a first pixel, and wherein the non-firing pulse of the first pixel period is applied as a drive pulse to the actuator element based on past image data and/or the stored scheduled image data.

20 Claims, 8 Drawing Sheets

(56) References Cited

U.S. PATENT DOCUMENTS

| | | | |
|---|---|---|---|
| 6,619,777 | B2 | 9/2003 | Chang |
| 6,685,293 | B2 | 2/2004 | Junhua |
| 6,742,859 | B2 | 6/2004 | Yonekubo et al. |
| 7,681,971 | B2 | 3/2010 | Berger et al. |
| 8,613,489 | B2 | 12/2013 | Tsukamoto et al. |
| 2003/0234826 | A1 | 12/2003 | Hosono et al. |
| 2006/0082607 | A1 | 4/2006 | Takahashi |
| 2007/0070102 | A1* | 3/2007 | Takata ..... B41J 2/04505 347/10 |
| 2010/0245425 | A1 | 9/2010 | Suzuki |
| 2012/0274689 | A1 | 11/2012 | Zhang |
| 2013/0063507 | A1 | 3/2013 | Sasaki |
| 2014/0022294 | A1 | 1/2014 | Satou et al. |
| 2014/0125722 | A1 | 5/2014 | Otokita |
| 2015/0049136 | A1 | 2/2015 | Menzel |
| 2015/0116400 | A1 | 4/2015 | Sasaki |

FOREIGN PATENT DOCUMENTS

| | | |
|---|---|---|
| EP | 2653312 | 10/2013 |
| JP | 2012126046 | 7/2012 |

OTHER PUBLICATIONS

International Search Report for PCT/GB2016/054027 dated Mar. 22, 2017.

Combined Search and Examination Report dated Jun. 22, 2016 for GB1522543.6.

* cited by examiner

82(i) t(pixel)
82(ii) t(pixel)
80
84(i)
88(i)
84(ii)
88(ii)
86
86
86
90(i)
86
86
86
90(ii)

62
92(i)
92(ii)
Greyscale Level 2
Greyscale Level 0

70
70
70
70
70
Open
Closed 97
96(i)
96(ii)
96(iii)

DROPLET-DEPOSITION APPARATUS AND METHODS OF DRIVING THEREOF

CROSS REFERENCE TO RELATED APPLICATIONS

This application claims the benefit of International Application No. PCT/GB2016/054027 filed Dec. 21, 2016, having a claim of priority to GB patent application number 15 22543.6, filed Dec. 21, 2015.

The present invention relates to a droplet deposition apparatus. It may find particularly beneficial application in a printer, such as an inkjet printer.

Droplet deposition apparatuses, such as inkjet printers are known to provide controlled ejection of droplets from a droplet deposition head, and to provide for controlled placement of such droplets to create pixels on a receiving or print medium.

Droplet deposition heads, such as inkjet printheads generally comprise one or more pressure chambers each having associated ejection mechanisms in the form of actuator elements.

The actuator elements are configured to deform in a controlled manner in response to a signal, e.g. a waveform comprising one or more drive pulses, thereby causing droplets to be generated and ejected from nozzles associated with the respective one or more pressure chambers. The actuator elements may be provided in different configurations depending on the specific application. For example the actuator elements may be provided in roof mode or shared wall configurations.

Embodiments may provide improved droplet deposition apparatuses, droplet deposition heads, or methods of driving such heads.

Aspects of the invention are set out in the appended claims.

Figures 2A, 2B:
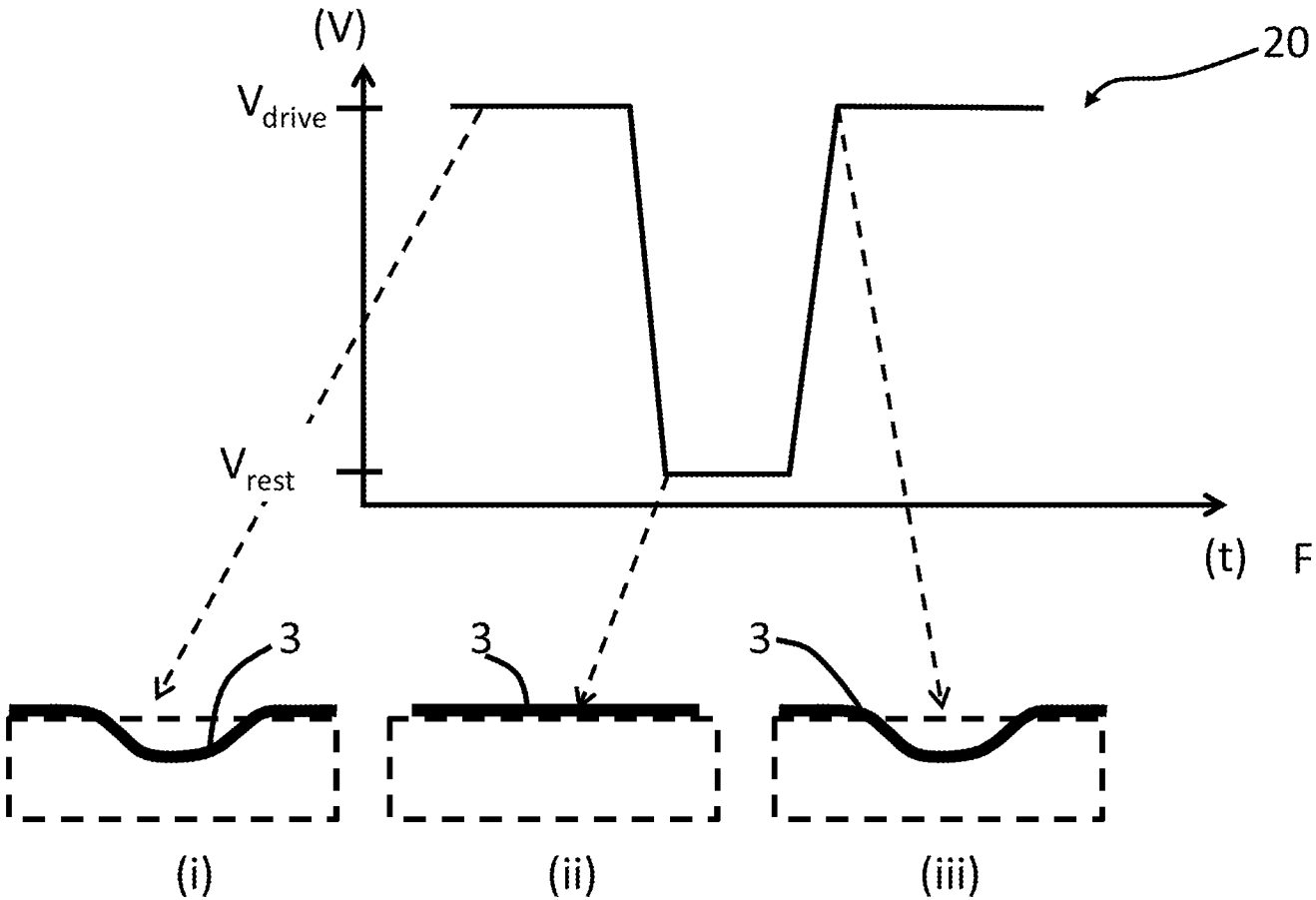
Figure 3A:
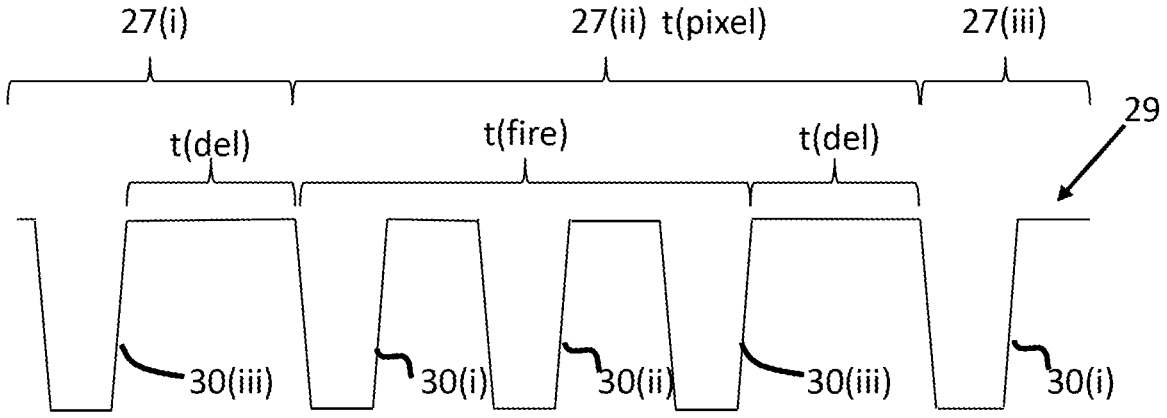
Figure 3B:
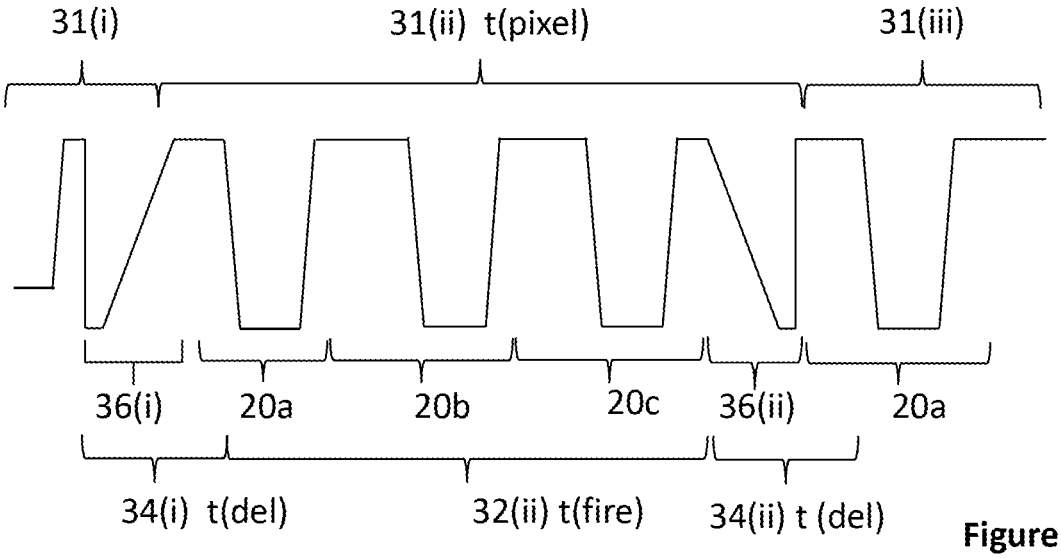
Figure 3C:
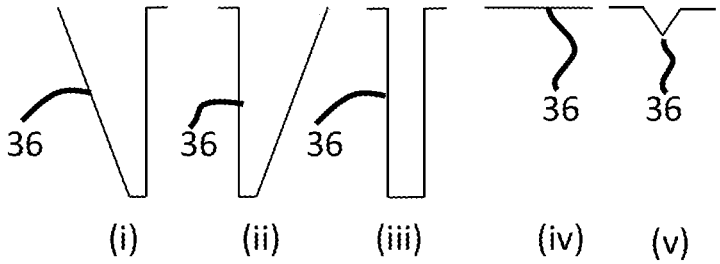

Embodiments will now be described with reference to the accompanying figures of which:

FIG. 1 schematically shows a cross section of a part of a droplet deposition head of a droplet deposition apparatus according to an embodiment;

FIG. 2*a* schematically shows an example of a firing pulse of a common drive waveform according to an embodiment;

FIG. 2*b* schematically shows the effect the firing pulse has on a membrane when applied, as a drive pulse, to an actuator element associated with the membrane;

FIG. 3*a* schematically shows three pixel periods of a common drive waveform;

FIG. 3*b* schematically shows three pixel periods of a common drive waveform, according to an embodiment;

FIG. 3*c* schematically shows examples of different non-firing pulses which may be included in the non-firing phase of the pixel periods of FIG. 3*b;*

Figure 4:
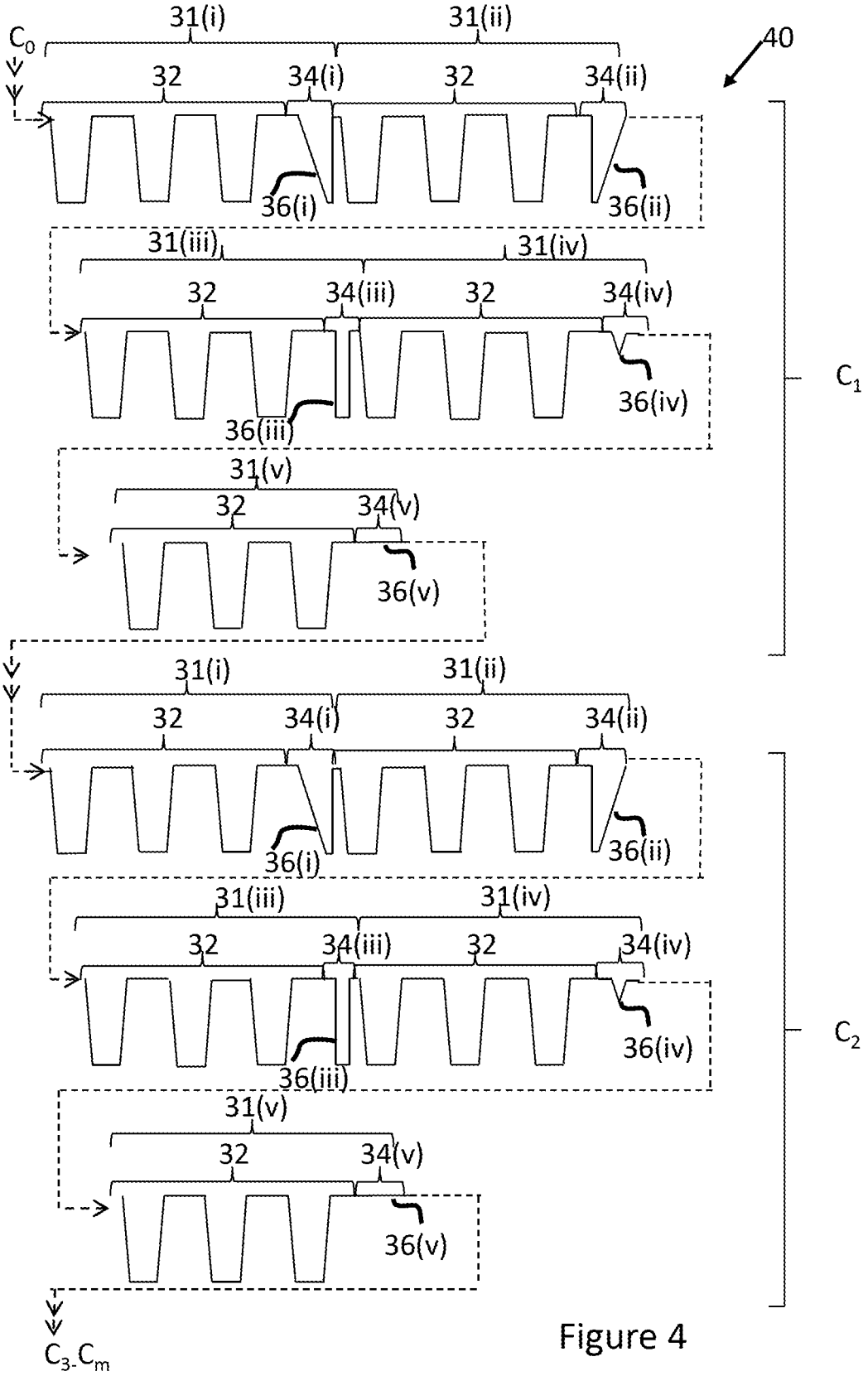
Figure 5A:
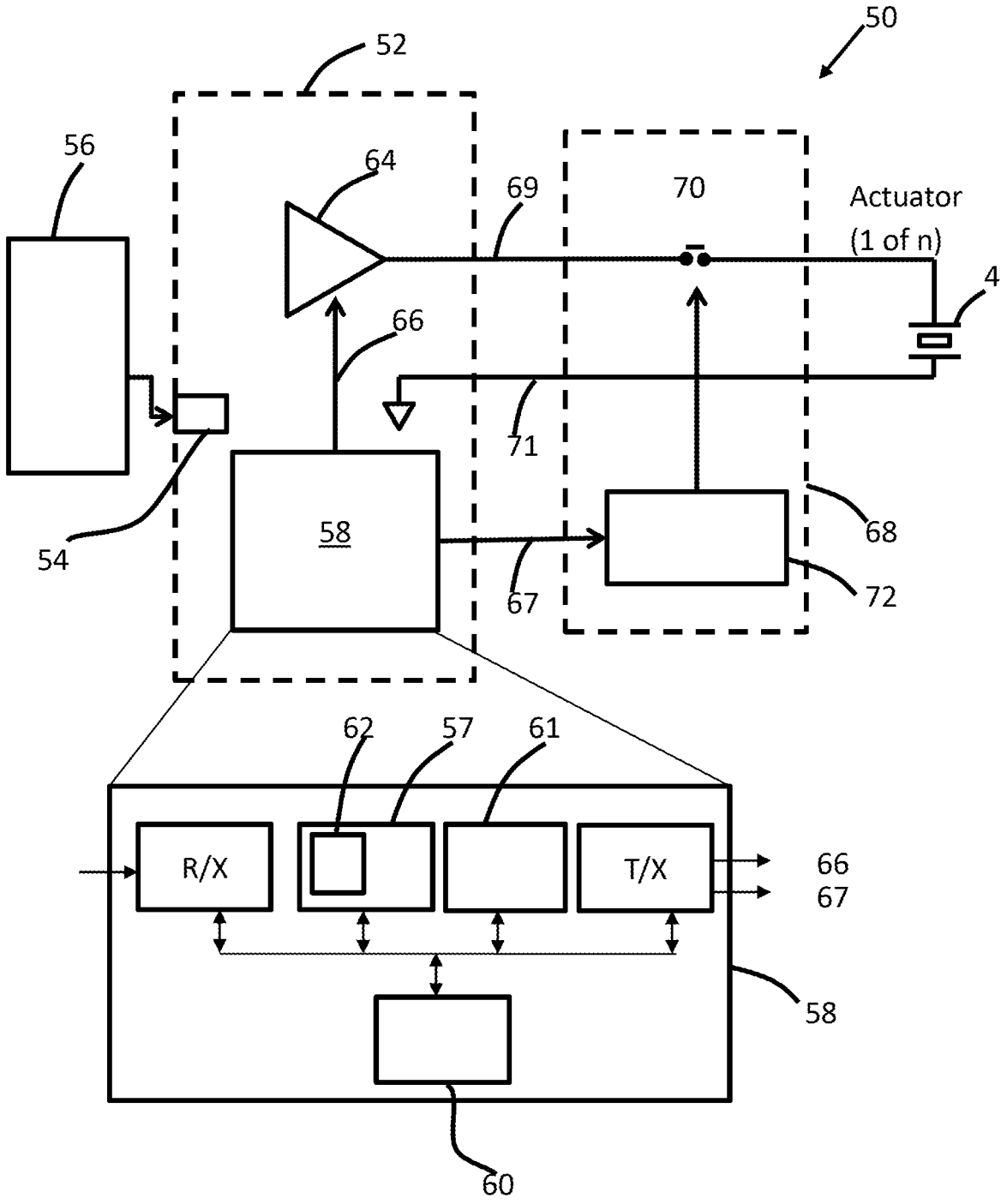
Figure 5B:
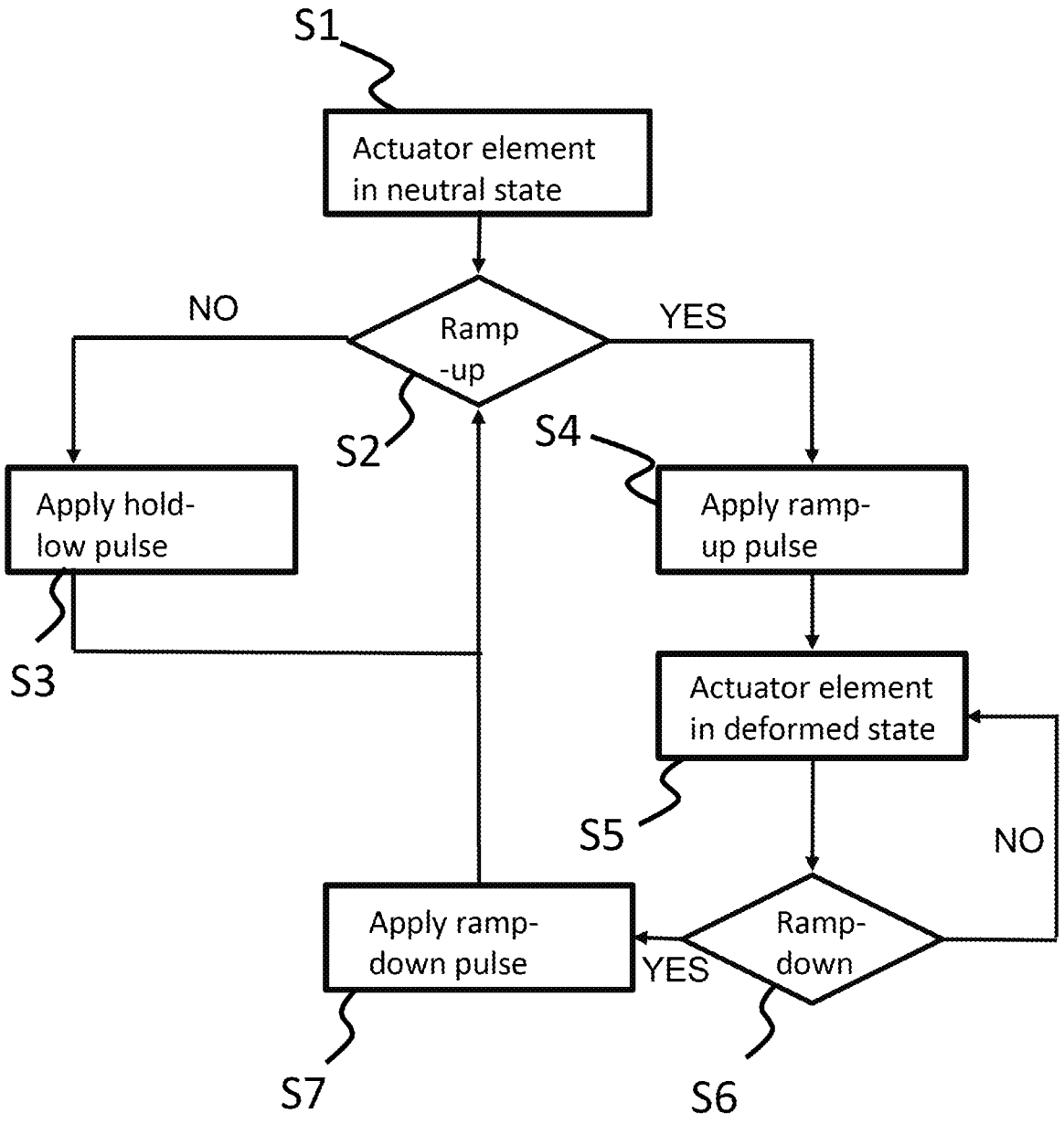
Figures 6A, 6B, 6C, 6D:
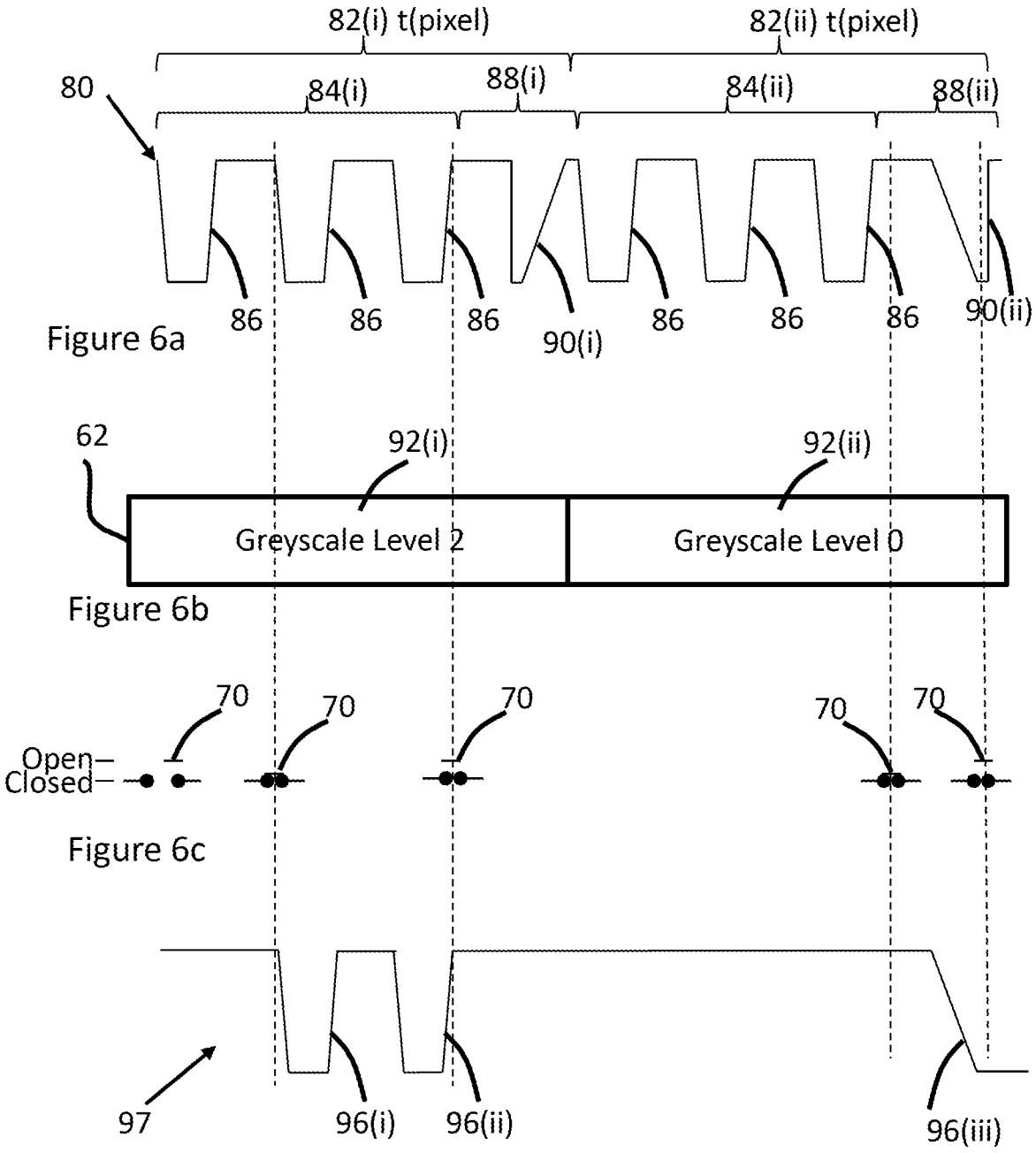

FIG. 4 schematically shows two cycles of common drive waveform according to an embodiment;

FIG. 5*a* schematically shows a block diagram of a droplet deposition apparatus according to an embodiment;

FIG. 5*b* illustrates a flow diagram showing an example of how a system control unit generates a pixel-control signal according to an embodiment;

FIG. 6*a* schematically shows an example of a common drive waveform according to an embodiment;

FIG. 6*b* schematically shows an example of scheduled image data according to an embodiment;

FIG. 6*c* schematically shows a state of switch-logic to apply firing and non-firing pulses in the common drive waveform of FIG. 6*a* as drive pulses to an actuator element;

FIG. 6*d* shows a waveform which depicts a charge state of an actuator element in response to the drive pulses of FIG. 6*c;*

Figure 7A:
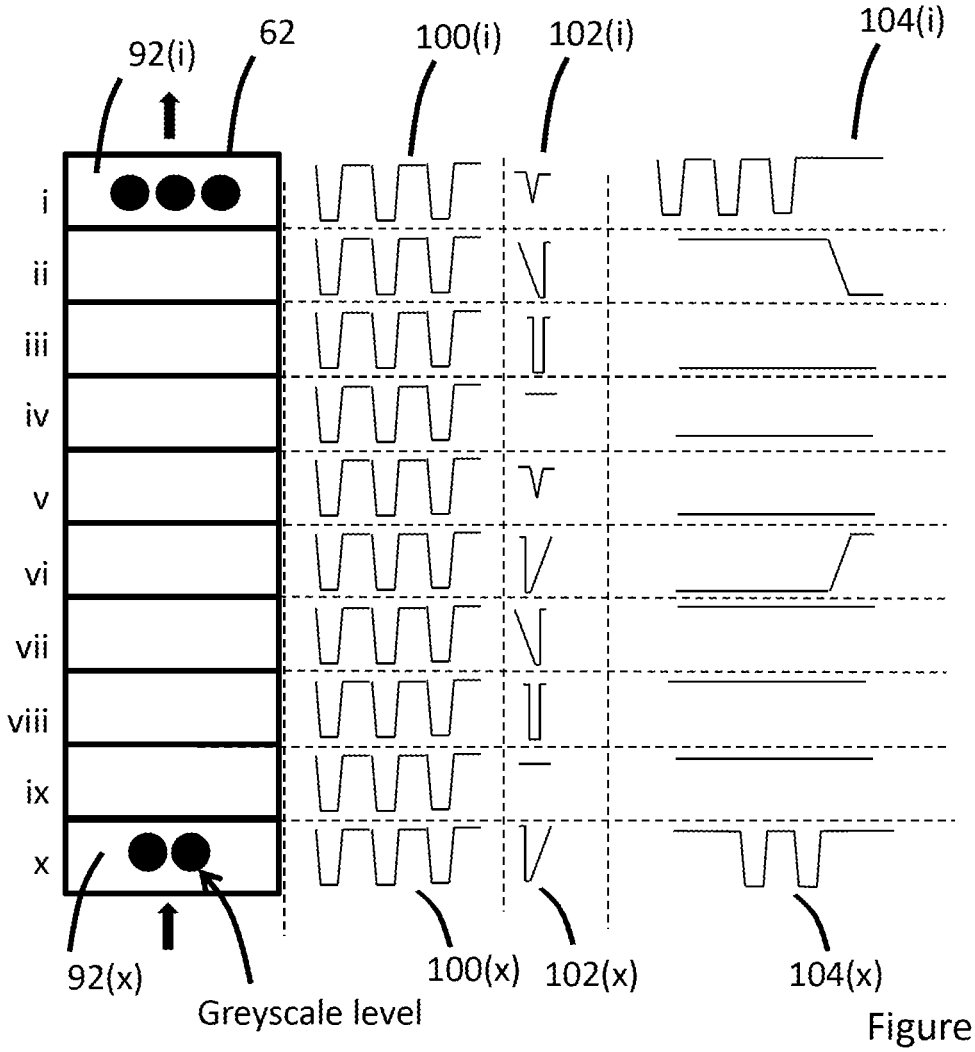
Figure 7B:
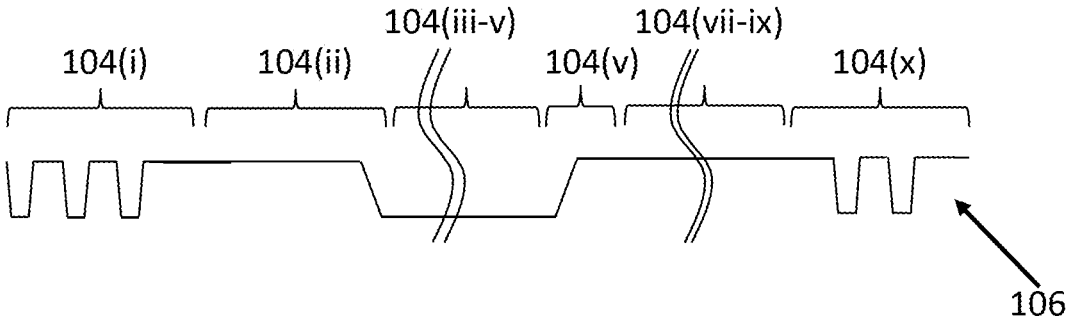

FIG. 7*a* schematically shows a representation of a buffer capable of storing scheduled image data and of firing and non-firing phases according to an embodiment; and FIG. 7*b* schematically shows a waveform depicting a charge state of the actuator element in response to the firing and non-firing phases of FIG. 7*a*.

The present invention will be described with respect to particular embodiments and with reference to figures but note that the invention is not limited to features described, but only by the claims. The figures described are only schematic and are non-limiting examples. In the figures, the size of some of the elements may be exaggerated and not drawn to scale for illustrative purposes.

FIG. 1 schematically shows a cross section of part of a droplet deposition head 1 of a droplet deposition apparatus according to an embodiment.

The droplet deposition head 1 comprises at least one pressure chamber 2 having a membrane 3 with an actuator element 4 provided thereon to effect movement of the membrane 3 between a first position (depicted as P1), here shown as a neutral position, inwards into the pressure chamber to a second position (depicted as P2). It will also be understood that the actuator element could also be arranged to deflect the membrane in a direction from P1 opposite to that of P2 (i.e. outwards of the pressure chamber).

In the present examples, the actuator element 4 is depicted as being located on a membrane 3 forming a wall of the pressure chamber 2 that faces a nozzle 12 provided on a bottom wall of the pressure chamber 2 opposite the membrane 3. However, in other examples, the actuator element 4 may be arranged elsewhere within the pressure chamber 4 and in fluid communication with the nozzle, e.g. as via a descender, or so as to form the side walls in a bulk piezoelectric actuator.

The pressure chamber 2 comprises a fluidic inlet port 14 for receiving fluid from a reservoir 16 arranged in fluidic communication with the pressure chamber 2.

The reservoir 16 is merely depicted adjacent the pressure chamber 2 for illustrative purposes. It could for example be provided further upstream, or remote from the droplet deposition head using a series of pumps/valves as appropriate.

The pressure chamber 2 optionally comprises a fluidic outlet port 18 for recycling any excess fluid in the pressure chamber 2 back to the reservoir 16 (or to another destination). In embodiments where the fluidic outlet port 18 is closed or no fluidic outlet port 18 is provided, then the fluidic inlet port 14 may merely replenish fluid that has been ejected from the pressure chamber 2 via the nozzle 12. In embodiments, the fluidic inlet 14 and/or fluidic outlet port 18 may have a one way valve.

In the present examples, the actuator element 4 is a piezoelectric actuator element 4 whereby a thin film of piezoelectric material 6 is provided between a first electrode 8 and a second electrode 10 such that applying an electric field across the actuator element 4 causes the actuator element 4 to charge, such that it experiences a strain and deforms. It will be understood that any suitable actuator element 4 as appropriate may be used instead of a piezoelectric actuator element.

In the schematic example in FIG. 1, the pressure chamber 2 is arranged in what is commonly referred to as a "roof-mode" configuration, whereby deflection of the membrane 3 changes the volume, and, therefore the pressure, within the pressure chamber 2. By applying a suitable deflection sequence to the membrane 3 such that sufficient positive pressure is generated within the pressure chamber 2, a droplet is ejected from the nozzle 12. This pressure change causes a pressure wave that reflects off the boundary structures of the pressure chamber, such as the bounding surfaces, and causes residual pressure waves in the pressure chamber that are typically undesirable and impact the properties of subsequently ejected droplets. By carefully designing and controlling the drive pulses applied to the actuator element 4, it is possible to achieve predictable and uniform droplet ejection properties from the nozzle 12.

Such control may be achieved by applying one or more drive pulses in the form of a voltage waveform to the actuator element 4 e.g. to the first electrode 8, whilst maintaining the bottom electrode 10 at a reference potential such as ground potential.

As is known from the art, a common drive waveform comprises a sequence of firing pulses, whereby one or more of the firing pulses may be applied as a drive pulse to one or more actuator elements of the droplet deposition head, for deflecting an associated membrane.

The droplet deposition head 1, and the associated features thereof (e.g. nozzle, actuator element, membrane, fluid ports etc.) may be fabricated using any suitable fabrication processes or techniques, such as, micro-electrical-mechanical systems (MEMS) processes.

Furthermore, whilst only one pressure chamber 2 is depicted in FIG. 1, it will be understood that any number of pressure chambers may be arranged in a suitable configuration. For example, the pressure chambers may be spaced along a linear array or may be staggered relative to each other.

FIG. 2*a* schematically shows an example of a firing pulse 20 of a common drive waveform according to an embodiment. In the present embodiment, the horizontal axis represents time (t) and the vertical axis represents voltage (V).

In FIG. 2*a*, the firing pulse 20 comprises a first falling portion whereby a leading edge falls from a drive voltage ($V_{drive}$) to a rest voltage ($V_{rest}$).

The firing pulse also comprises a first rising portion whereby, after a time period, a trailing edge of the firing pulse 20 rises from $V_{rest}$ to $V_{drive}$.

As will be understood by a person skilled in the art, the firing pulse 20 of the common drive waveform may be applied to one or more actuator elements as a drive pulse, thereby deforming the membrane 3 sufficiently to draw fluid into the pressure chamber and to eject a droplet from a corresponding nozzle (not shown).

FIGS. 2*b* (i)-(iv) schematically shows, by example only, the effect the firing pulse 20 has on membrane 3 when applied as a drive pulse to an actuator element associated with the membrane 3.

For example, as shown at FIG. 2*b* (i), at $V_{drive}$, and before the leading edge, the membrane 3 is fully deformed. (In context, "fully deformed" is taken to be the amount of deformation of the membrane as a result of applying $V_{drive}$, and is not taken to be the maximum deformation achievable by a particular membrane). As the leading edge is applied, the membrane 3 changes from being in a fully deformed state to a state as defined by $V_{rest}$, thereby drawing fluid into the pressure chamber. In the present illustrative example as shown in FIG. 2*b* (ii), when $V_{rest}$ is applied, the actuator element is in a substantially neutral, non-actuated state. However, the actuator element may still display a degree of deformation due to residual stresses within the actuator materials.

At FIG. 2*b* (iii), at $V_{drive}$, the membrane 3 returns to being fully deformed such that a droplet is ejected from an associated nozzle.

As will be understood by a person skilled in the art, by providing a sequence of firing pulses in a common drive waveform, and selectively applying one or more of the firing pulses 20 as drive pulses to actuator elements, the resulting droplets may be controlled to accurately land on a receiving medium (in conjunction with controlling a motion of a receiving medium, where necessary) within predetermined areas defined as pixels. These pixels are the theoretical projection onto the receiving medium based on a rasterization of the image that is to be printed as derived from image data.

In a simple binary representation, each pixel will be filled with either one or no droplet. In a more developed representation, greyscale levels may be added by printing more than one droplet into each pixel to alter the perceived colour density of the image pixel. In this case, the droplets landing within the same pixel will generally be referred to as sub-droplets. Where ejected from the same nozzle, such sub-droplets may be ejected in rapid succession so as to merge in-flight before landing on the receiving medium as one droplet of a volume that is the sum of all sub-droplet volumes. Once landed on the receiving medium, the droplet will, in the following text, be referred to as a 'dot'; this dot will have a colour density defined by the droplet volume or the sum of all sub-droplet volumes.

As will also be understood, firing pulses are not limited to the shape depicted in FIG. 2*a*, and any suitable shapes may be used to eject droplets as required. For example a trapezoidal, rectangular or square wave firing pulse may be used. Furthermore, characteristics of the firing pulses may be changed as appropriate. Such characteristics include but are not limited to: amplitude, pulse width, slew rates etc. Furthermore, in embodiments the firing pulse may be followed by one or more cancellation pulses (not-shown) which are used to generate pressure waves which constructively interfere with the pressure waves caused by the firing pulse.

FIG. 3*a* schematically shows three pixel periods 27(*i*)-(*iii*) of a common drive waveform 29. In context, a pixel period refers to the duration of a common drive waveform 29 for addressing one pixel with a droplet, or sub-droplets.

The duration of each pixel period ($t_{pixel}$), and therefore the pixel frequency ($1/t_{pixel}$), may be determined by one or more factors, whereby the factors may relate to characteristics of the droplet deposition head such as the Helmholtz frequency of the respective pressure chambers, aerodynamic interactions of the droplets, operating capabilities/efficiency of the head control logic. Additionally or alternatively the factors may relate to the requirements of a particular printing application such as the greyscale requirements, velocity of the receiving medium relative to the droplet deposition head or the desired print resolution.

Each pixel period 27(*i*)-(*iii*) comprises a firing phase having a firing period ($t_{fire}$). Each firing phase may have one or more firing pulses (depicted as three firing pulses in FIG. 3*a*). Note, in FIG. 3*a*, pixel periods 27(*i*) & 27(*iii*) are only partially depicted.

The number of firing pulses in a pixel period may be set by the width of the pulses and the time between them. When $t_{pixel} > t_{fire}$, there is a delay interval ($t_{del}$) between consecutive pixel periods, as depicted in FIG. 3*a*.

When $t_{pixel} \leq t_{fire}$, but where, due e.g. to high frequency operation, the droplet ejection properties may develop lower reliability compared to a lower frequency application, a delay interval ($t_{del}$) may be incorporated/engineered into the common drive waveform between consecutive firing periods, whereby the addition of a delay interval ($t_{del}$) may improve the reliability of the droplet ejection properties.

Whilst the delay interval ($t_{del}$) decreases the pixel frequency, the inclusion of at least one non-firing phase in the delay interval ($t_{del}$) provides for added beneficial functionality so as to offset the negative impact on the pixel frequency.

Such benefits may include, but are not limited to: improving the lifetime of the one or more actuator elements, prolonging up-time before nozzle maintenance is required and preventing nozzle blockages.

Therefore, when $t_{del}$ is required or provided between consecutive filing phases, the addition of at least one non-firing pulse between consecutive firing phases is tolerable given the advantageous benefits provided thereby.

FIG. 3*b* schematically shows three pixel periods 31(*i*)-(*iii*) of a common drive waveform, according to an embodiment. Each pixel period 31(*i*)-(*iii*) comprises a firing phase 32 and a non-firing phase 34. Note, in FIG. 3*b*, pixel periods 31(*i*) & (*iii*) are only partially depicted.

In FIG. 3*b*, the firing phase 32 is depicted as comprising three firing pulses 20*a*-20*c*, having substantially similar shaped firing pulses to that described above in FIG. 3*a*.

In the present embodiment, a non-firing phase 34 is provided in the common drive waveform between consecutive firing phases.

Each non-firing phase 34 in the illustrative example of FIG. 3*b* comprises a non-firing pulse 36, which may be operable to effect deformation or non-deformation of an actuator element when applied thereto as a drive pulse, but the at least one non-firing pulse 36 does not result in ejection of a droplet from a corresponding nozzle.

In FIG. 3*b*, the non-firing phases 34(*i*) and (ii) are depicted as comprising a single ramp-up pulse 36(*i*) and a single ramp-down pulse 36(*ii*) ('up' and 'down' referring to the neutral and deformed state, respectively), however other non-firing pulses having different characteristics may be used instead.

FIG. 3*c* schematically shows examples of non-firing pulses 36 having different characteristics which may be included in the common drive waveform. As above, the application of such non-firing pulses 36 as drive pulses may provide advantageous functionality for the droplet deposition apparatus.

For example, when in a deformed state, mechanical and electrical stresses may be imparted on the actuator element, thereby decreasing the lifetime of the actuator element through mechanical fatigue or decrease in piezoelectric polarisation. Therefore, it may be advantageous to place the actuator element in a neutral state when appropriate (e.g. when not scheduled to eject a droplet over a predetermined period of time).

Therefore, an example of a non-firing pulse 36 operable to provide such advantageous functionality comprises a ramp-down pulse as depicted in FIG. 3*c* (i), whereby the leading edge transitions from $V_{drive}$ to $V_{rest}$, but wherein the slew rate of the leading edge is insufficient to cause the ejection of a droplet.

Alternatively, when in a neutral state, it may be preferable to transition to a deformed state at $V_{drive}$ before, and in anticipation of, applying a drive pulse, although such a transition from the neutral state should preferably occur without ejection of a droplet.

Therefore, a further example of a non-firing pulse 36 is depicted in FIG. 3*c* (ii), and comprises a ramp-up pulse, whereby the trailing edge transitions from $V_{rest}$ to $V_{drive}$, but wherein the slew rate of the trailing edge is insufficient to cause ejection of a droplet. However, it will be understood that the slew rate may impact on the achievable pixel frequency, and, therefore, may be set dependent on the requirements of the application.

Whilst this prepares the actuator element to be ready to fire a droplet without unnecessary delay, the more gradual a transition from, for example, a rest voltage, to a drive voltage level can be made, the less energy will be dissipated in the device, and, therefore, pressure waves resulting from the ramp-up pulse can be minimised.

In other examples, the voltages for the ramp type pulses may transition between $V_{rest}$ and an intermediate voltage between $V_{rest}$ and $V_{drive}$.

In some examples, variations in pressure in the pressure chamber may result in the membrane deforming and charging the actuator over a prolonged period of time.

Therefore, a further example of a non-firing pulse 36 is depicted in FIG. 3*c* (iii), and comprises a hold-low pulse, whereby the hold-low pulse applies $V_{rest}$ in a short period without ejection of a droplet. The hold-low pulse will preferably only be applied to an actuator element in a neutral state, whereby the hold-low pulse is a stabilising voltage applied to an actuator element which is in a neutral state for a prolonged period of time. This may address issues with for example charging of the actuator element over time due to the piezoelectric material responding to pressure changes, whereby such a hold-low pulse returns the actuator to a desired level.

A further example of a non-firing pulse 36 is depicted in FIG. 3*c* (iv), and comprises a hold-high pulse, which may be applied as a stabilising voltage when the actuator element is not powered down for a period of time, and may discharge slowly due to current leakage paths in the system. Such a hold-high pulse returns the actuator to a desired level.

In some examples, a meniscus surface in a non-ejecting nozzle may begin to dry, pin along the contact line and/or 'skin' over, causing print defects when a droplet is ejected.

Therefore, a further example of a non-firing pulse 36 is depicted in FIG. 3*c* (v), and comprises a meniscus-vibration pulse, whereby the meniscus-vibration pulse transitions from $V_{drive}$ to a meniscus-vibration voltage $V_{men}$ and transitions back to $V_{drive}$, whereby the meniscus-vibration pulse is capable of vibrating the meniscus in the nozzle and agitating the fluid within the nozzle such as to prevent the meniscus from pinning and skinning over.

Other non-firing pulses having different characteristics and effects on droplet ejection properties than those described in FIG. 3*c* may also be provided, as will be apparent to a person skilled in the art taking account of the teachings herein.

Control circuitry (not shown), such as a waveform generator, is configured to generate the common drive waveform, and the control circuitry may also define the characteristics of the respective firing and non-firing pulses.

Such characteristics may, apart from those previously listed, may also include the time interval between firing pulses in the same firing phase, the time interval between the last firing pulse and the first non-firing pulse in the same pixel period, and/or the time interval between the first firing pulse of a pixel period and the last non-firing pulse of a preceding pixel period.

For embodiments described herein, all pixel periods along the length of the common drive waveform are depicted as comprising firing phases having substantially identical characteristics, whereby each firing phase is depicted in an exemplary manner as comprising three firing pulses (but could comprise more depending on the highest level of greyscale required per nozzle).

However, it will be understood by a person skilled in the art taking account of the teachings herein that there is no requirement for the pixel periods to comprise firing phases having substantially identical characteristics. For example, in embodiments, a common drive waveform may have firing phases comprising only one firing pulse, whilst other pixel periods may have firing phases with two or more firing pulses and/or firing pulses with different characteristics. Furthermore, the firing phases may include one or more cancellation pulses to dampen pressure waves in the pressure chamber when a firing pulse is applied. Whilst the cancellation pulses do not cause ejection of a droplet, they are considered to be part of the firing phase in which they are included.

In embodiments, the common drive waveform may comprise cycles of pixel periods, whereby a cycle comprises two or more consecutive pixel periods, whereby the cycles are repeated for the duration of the common drive waveform.

It is preferable that one cycle comprises all non-firing pulses available to/generated by the control circuitry. As the cycles are repeated, only one cycle is required to be generated initially, reducing any processing requirement when generating a common drive waveform comprising repeating cycles in comparison to when the non-firing phases are newly generated for each pixel period for the duration of the common drive waveform.

Such functionality may further enable the control circuitry to more easily predict when a certain non-firing pulse is scheduled in the common drive waveform and, therefore, more easily to determine when to apply a particular non-firing pulse as a drive pulse.

In the following examples all the non-firing phases in the same cycle have different characteristics from one another, whereby the non-firing pulses of the non-firing phases in the same cycle have different characteristics from one another.

However, in alternative examples, non-firing phases in the same cycle may have the same characteristics as one another.

FIG. 4 schematically shows a common drive waveform 40 having 0 to m cycles C, m being an integer, whereby two cycles, C1 & C2 are illustratively shown.

Each cycle in the common drive waveform 40 comprises five pixel periods depicted as 31(*i*)-31(*v*), each having substantially identical firing phases 32 and each further having a non-firing phase 34(*i*)-(*v*) with different characteristics from one another.

Specifically, in the present illustrative example depicted in FIG. 4, the non-firing phases 34(*i*)-(*v*) comprise different non-firing pulses 36 from one another, whereby 34(*i*) comprises a ramp-down pulse 36(*i*); 34(*ii*) comprises a ramp-up pulse 36(*ii*); 34(*iii*) comprises a hold-low pulse 36(*iii*); 34(*iv*) comprises a meniscus-vibrate pulse 36(*iv*); whilst 34(*v*) comprises a hold-high pulse 36(*v*).

The cycles are repeated for the duration of the common drive waveform whilst circuitry associated with the droplet deposition apparatus is configured to selectively apply one or more of the firing and/or non-firing pulses of the common drive waveform as drive pulses to one or more actuator elements.

It will be understood that by scheduling at least one of the non-firing pulses in a pixel period, and scheduling all types of non-firing pulse over the length of a cycle it is possible to apply all types of non-firing pulses as drive pulses over one or more cycles.

Furthermore, by using a scheduling scheme and monitoring a number of pixels in advance it is possible to ensure that a particular type of non-firing pulse can be applied as a drive pulse to the one or more actuator elements when determined to be appropriate.

The particular scheduling scheme used by the control circuitry may be based on a simple rotation scheme, whereby all available non-firing pulses are rotated for the duration of the common drive waveform. Alternatively, any level of simple or complex logic may be applied based on past image data and/or scheduled image data to determine which non-firing pulse would be the most effective for a particular pixel period to provide most benefit for the one or more actuator elements.

FIG. 5*a* schematically shows a block diagram of a droplet deposition apparatus 50, configured to generate a common drive waveform with consecutive pixel periods having firing and non-firing phases, and configured to selectively apply one or more of the firing and/or non-firing pulses of the common drive waveform as drive pulses to one or more actuator elements. The firing and non-firing pulses may be applied independently of each other.

As above, the droplet deposition apparatus 50 may comprise a plurality of 'n' actuator elements 4 configured to eject droplets (where 'n' is an integer), in a controlled manner from nozzles associated therewith. For the purposes of clarity, only one actuator element 4 is schematically shown in FIG. 5*a*.

The droplet deposition apparatus 50 includes control circuitry 52 configured to control the functionality of the droplet deposition apparatus 50.

For example, the control circuitry 52 includes communication circuitry 54 for transmitting/receiving communications to/from one or more external sources 56, depicted as a host computer 56 in FIG. 5*a*.

The communication circuitry 54 may be an interface unit for receiving image data sent from the host computer 56, and may include a serial interface such as USB (Universal Serial Bus), IEEE1394, Ethernet, wireless network, or a parallel interface.

The control circuitry 52 further comprises a system control unit 58, which has processing logic 60 to process data (e.g. the image data, programs, instructions received from a user etc.) and generate output signals in response to the processed data. The system control unit 58 may comprise any suitable circuitry or logic, and may, for example, comprise a field programmable gate array (FPGA), system on chip device, microprocessor device, microcontroller or one or more integrated circuits.

In the present embodiment, the system control unit 58 comprises storage 57 for storing data (e.g. image data) received thereat. The storage 57 may comprise volatile memory such as random access memory (RAM), for use as temporary memory whilst the system control unit 58 is operational. Additionally or alternatively, the storage 57 may comprise non-volatile memory such as Flash, read only memory (ROM) or electrically erasable programmable ROM (EEPROM), for storing programs, or instructions received from a user thereat.

As above, it may be inappropriate to apply certain non-firing pulses as drive pulses to the actuator element when in a particular state.

For example, it may be detrimental to the lifetime of the actuator element to apply a hold-low pulse thereto when in a deformed state. Furthermore, it may be detrimental to the lifetime of the actuator element to apply a hold-high pulse thereto when in a neutral state.

Therefore, the control unit 58 may further comprise a state machine 61 configured to generate and/or store state data relating to the charge state of each actuator element, such that the control unit 58 can determine whether a particular actuator element is in a deformed state or a neutral state, and, therefore, whether or not it is appropriate to apply a particular non-firing pulse as a drive pulse to a particular actuator element.

In the present embodiment, image data sent from the host computer 56 is received at the system control unit 58 via the communication circuitry 54, and stored in the storage 57.

The image data relates to the desired characteristics of a pixel to be created on a receiving medium (e.g. pixel position, density, colour etc.). As such the image data may define the characteristics of the droplets required to be ejected from a particular nozzle to create the pixel.

On receiving the image data at the system control unit 58 (e.g. at R/X), it is temporarily stored in a buffer 62 in storage 57. In the present illustrative examples the buffer 62 is a first-in-first-out (FIFO) buffer, whereby data is output in the order in which it was input to the buffer 62, although any suitable buffer may be provided.

The buffer 62 is arranged to store image data for a next 'n' pixels to be filled by an actuator element. Image data stored in the buffer 62 is hereinafter referred to as "scheduled image data". It will be understood that the buffer 62 may be configured to store scheduled image data for each individual actuator element.

The control circuitry 52 includes a waveform generator 64, which is configured to generate a common drive waveform in response to a waveform-control signal 66. As an illustrative example, the waveform-control signal 66 comprises a logic output which is fed to a digital-to-analog converter (DAC) (not shown), whereby an analog output from the DAC is fed to an amplifier for generating the common drive waveform.

The common drive waveform is transmitted to head-control circuitry 68 on the droplet deposition apparatus 50, along a transmission path 69 so as to be selectively applied as one or more drive pulses to the one or more actuator elements 4. It will also be understood that the one or more actuator elements 4 are connected to a common return path 71.

In the present embodiment the system control unit 58 generates the waveform-control signal 66 in response to the scheduled image data and/or other data in storage 57, whereby the waveform-control signal 66 defines the characteristics of the respective firing and non-firing phases in the common drive waveform.

Such other data in storage 57 may include a program or instructions received from a user and/or may also include configurational data, whereby the configurational data may relate to the operating parameters of the actuating elements, for example optimised or calibrated operating drive voltages for the actuator elements. Such configurational data may be recorded at manufacture of the respective actuator elements and provided in storage 57, for example, to be processed after installation of the droplet deposition head in the droplet deposition apparatus.

Additionally or alternatively, the configurational data in storage 57 may relate to the particular type of fluid (e.g. ink) being used to print, whereby the waveform-control signal 66 may be used to select the shape of the firing pulses in the common drive waveform dependent on a particular type of ink being used to print.

The waveform-control signal 66 may also be used to define the characteristics of the non-firing pulses and the timing thereof in the common drive waveform.

As above, there may a pre-defined selection of non-firing pulses in storage 57 from which the control circuitry can select the non-firing pulses to be included in the common drive waveform. Alternatively, the control circuitry may be configured to generate and include non-firing pulses on a random or pseudorandom basis and/or the non-firing pulses may be generated and included in response to a program in storage or instructions received from a user.

For example, the non-firing pulses could be included in the common drive waveform in response to an algorithm which determines the sequence of non-firing pulses which will provide optimum benefit for the actuator elements, as will become apparent to a person skilled in the art taking account of the teachings herein.

Additionally or alternatively, rules in storage 57 on the droplet generation apparatus may determine the inclusion of the non-firing pulses in the common drive waveform for each pixel period to optimise its effectiveness across the row of actuator elements for the specific pixel period, whereby such rules may include, but are not limited to (i) always include a meniscus-vibration pulse every 'n' pixel periods; (ii) always include at least one ramp-down pulse every cycle; (iii) always include at least one ramp-down pulse every cycle etc.

The waveform-control signal 66 may also define the characteristics of the respective cycles of the common drive waveform such as the number of pixel periods per cycle.

In the illustrative example of FIG. 5*a*, head-control circuitry 68 comprises drive circuitry, such as an application specific integrated circuit (ASIC), which comprises switch-logic 70 for the one or more actuator elements 4. The control circuitry 52 and head-control circuitry 68 may be provided in communication with each other using any suitable means. For example, one or more cables may be used including a low-voltage differential signalling cable. In some examples, some or all of the functionality of the control circuitry 52 may be provided as part of the head-control circuitry 68 as required, or may alternatively be provided by one or more external source 56.

The switch-logic 70 is configured, dependent on the state thereof, to pass the common drive waveform therethrough in a controllable manner such that the respective firing and non-firing pulses can be selectively applied as drive pulses to the one or more actuating elements 4.

For example, the switch-logic 70 may be in a closed state to allow the common drive waveform to pass therethrough to be applied to the associated actuator element 4, or the switch-logic 70 may be in an open state to prevent the common drive waveform passing therethrough and being applied to the associated actuator element 4.

In examples the switch-logic 70 may comprise one or more transistors arranged in a suitable configuration, such as a pass gate configuration.

In the present example, the state of the switch-logic 70 is controllable by a switch-logic-control unit 72 in response to a pixel-control signal 67 received from the control circuitry 52.

The pixel-control signal 67 comprises data defining when the switch-logic-control unit 72 should control the state of the switch-logic 70 so as to apply drive pulses to the respective actuator elements 4.

In examples, the pixel-control signal 67 may be a relatively simple logic signal (high or low). For example, when the pixel-control signal 67 is 'high' the switch-logic 70 may be required to be in a closed state and when the pixel-control signal 67 is 'low' the switch-logic 70 may be required to be in an open state.

In the present illustrative example the system control unit 58 may generate the pixel-control signal 67 in response to various data, including but not limited to: the image data, the scheduled image data, the waveform-control signal 66 (e.g. defining the scheduled firing and non-firing pulses in the common drive waveform), state data from state machine 61 and/or other data stored in storage 57 such as, configurational data, a program instructions received from a user.

In embodiments, the generation of the pixel-control signal 67 may be based on rules provided as part of a program or instructions received from a user. For example, such rules may include but are not limited to (i): apply a meniscus-vibration pulse as a drive pulse after every 15 pixel periods; (ii) always apply a ramp-down pulse if no droplet ejection required within next 'n' (e.g. 4) pixel periods; (iii) never apply a ramp-down pulse if a ramp-up pulse is not scheduled for at least 2 pixel periods before droplet ejection (iv) always apply a hold-low pulse if in a neutral state and droplet ejection not required for 'n' pixel periods (v) always apply a ramp-up pulse if droplet ejection is required within next 'n' pixel periods.

FIG. 5*b* illustrates a flow diagram showing an example process of how the system control unit may generate a pixel-control signal based on rules in storage.

At S1 the process begins with the actuator element in a neutral state, for example, after a ramp-down pulse was previously applied.

At S2, the system control unit waits to apply a ramp-up pulse as per rules in storage, such as the example rules listed above. The system control unit may, based on scheduled image data in the buffer, determine when a droplet is required to be ejected by the actuator element.

If, for example, a droplet is not required within the next 'n' pixel periods, then as at S3, the pixel-control signal may be generated to cause a hold-low pulse, if available in the common drive waveform, to be applied as a drive pulse, whereby the process returns to S2.

Alternatively, if a droplet is required within the next 'n' pixel periods then, as at S4, the pixel-control signal may be generated to cause a ramp-up pulse, if available in the common drive waveform, to be applied as a drive pulse, such that actuator element is in a deformed state and ready to generate a droplet as at S5.

On generating a droplet, the system control unit, at S6, determines whether or not to apply a ramp-down pulse, whereby if a droplet is required to be ejected within the next 'n' pixel periods then, the process returns to S5, whereby the actuator element remains in a deformed state and ready to generate a droplet.

Alternatively, if a droplet is not required to be ejected within the next 'n' pixel periods then, as at S7, the pixel-control signal may be generated to cause a ramp-down pulse, if available in the common drive waveform, to be applied as a drive pulse, whereby the process returns to S2.

It will be understood that the process in FIG. 5*b* is provided by way of example only, and any type or number of rules may be used by the system control unit to generate a pixel-control signal such that other types of non-firing pulses may be applied as drive pulses as appropriate.

FIG. 6*a* schematically shows an example of a common drive waveform 80 according to an embodiment; FIG. 6*b* schematically shows scheduled image data in a buffer 62; FIG. 6*c* depicts the state of the switch-logic 70 in response to apply firing and non-firing pulses in the common drive waveform 80 as drive pulses 96(*i*)-(*iii*) to an actuator element; whilst FIG. 6*d* shows a waveform depicting a charge state of the actuator element in response to the drive pulses 96(*i*)-(*iii*).

FIG. 6*a* depicts two pixel periods 82(*i*) & 82(*ii*) of common drive waveform 80.

The firing phases 84(*i*) & (*ii*) of each respective pixel period 82(*i*) & 82(*ii*) comprise three firing pulses 86.

The non-firing phases 88(*i*) & (*ii*) each comprise a single non-firing pulse 90 (*i*) & (*ii*), whereby the non-firing pulse 90(*i*) comprises a ramp-up pulse, whilst the non-firing pulse 90(*ii*) comprises a ramp-down pulse.

In the present illustrative example, the buffer comprises scheduled image data 92(*i*) & 92(*ii*) which relate to two successive pixels to be filled by a particular actuator element.

For the first pixel, as defined by first scheduled image data 92(*i*), a greyscale value of 2 is required, whereby two sub-droplets are required to be ejected, whilst for the second pixel, as defined by second scheduled image data 92(*ii*), a greyscale value of 0 is required, whereby no droplet is required to be ejected.

As described above, the system control unit generates a pixel-control signal which is used to control the state of control switch-logic 70. In the present illustrative example, when the control logic 70 is in a closed state the common drive waveform is applied as a drive pulse to the actuator element and when the switch-logic 70 is in an open state the common drive waveform is prevented from being applied as a drive pulse.

As the first scheduled image data 92(*i*) requires a greyscale value of 2, the state of the control switch-logic 70 changes from open to closed after the first firing pulse in the first firing phase 84(*i*) whilst the state of the control switch-logic 70 changes from closed to open at the end of the third firing pulse in the first firing phase 84(*i*). Therefore, drive pulses 96(*i*)&(*ii*) are applied to the actuator element.

As depicted in the waveform 97, after the drive pulse 96(*ii*) is applied, the actuator element, which is a piezoelectric actuator, is charged and remains in a deflected state even when no drive pulse is applied.

Therefore non-firing pulse 90(*i*) is purposely not applied as a drive pulse because it is a ramp-up pulse and, in context, would provide no benefit to the charged actuator element.

The second scheduled image data 92(*ii*) requires a greyscale value of 0, and, therefore, no firing pulses from the second firing phase 84(*ii*) are applied as drive pulses to the actuator element and the state of the control switch-logic 70 is not changed.

However, the non-firing pulse 90(*ii*) is a ramp-down pulse, and, therefore, may be applied as drive pulse 96(*iii*) to the charged actuator, whereby the actuator element will change from a deformed state to a neutral state without ejection of a droplet. Whilst in the neutral state, mechanical and electrical stresses will be reduced in comparison to when the actuator element is in a deformed state, which may be beneficial to the lifetime of the actuator element.

It will be understood, that the ramp-down pulse may only be applied if it is determined to be appropriate to do so e.g. whereby a ramp-up pulse is scheduled in the common drive waveform such that the actuator element can be driven to a deformed state before a next droplet is required to be ejected.

In embodiments, and as described above, such a determination may be made, for example, by the system control unit based on various data, including but not limited to: the image data, the scheduled image data stored in a buffer, the waveform-control signal, state data from the state machine, rules as defined by a program in storage and/or instructions received from a user.

As an illustrative example, FIG. 7*a* schematically shows a buffer 62, capable of storing scheduled image data 92(*i*)-(*x*) relating to a next ten pixels for a particular actuator element. As above, the buffer 62 may also store scheduled image data for all actuator elements within the droplet deposition head.

In FIG. 7*a*, column 100(*i*)-(*x*) illustratively depicts the scheduled firing pulses corresponding to the next ten pixel periods, column 102(*i*)-(*x*) illustratively depicts the scheduled non-firing pulses of the next ten pixel periods. It will be understood that the scheduled firing and non-firing pulses correspond to the waveform control signal as previously described. Column 104(*i*)-(*x*) illustratively depicts the charge state of the actuator element in response to the drive pulses as applied thereto.

FIG. 7*b* schematically shows a waveform 106 which depicts the charge state of the actuator element in response to the drive pulses.

As above, the data in storage may determine the characteristics of the pixel periods of the common drive waveform. Furthermore, the types of non-firing pulses in the common drive waveform, or the interval between the same or different types of non-firing pulses may be defined, for example, based on the size of the buffer 62, which may be any size as required for a particular application.

As an illustrative example, the number of the ramp-up pulses included in a common drive waveform, or the interval between ramp-up pulses may be defined dependent on the size of the buffer, whereby if due to some limitation (e.g. a hardware or cost limitation), the buffer size is limited to storing scheduled image data for a next ten pixels, the common drive waveform may be generated so as to include at least one ramp-up pulse every ten pixel periods (e.g. as defined by the waveform-control signal).

As a further illustrative example, the number of the ramp-up and ramp-down pulses included in a common drive waveform, or the interval between ramp-up and ramp-down pulses may be defined dependent on the size of the buffer, whereby if the buffer size is limited to storing scheduled image data for a next ten pixels, the common drive waveform may be generated so as to include at least one ramp-down pulse and at least one ramp-up pulse every ten pixel periods.

Therefore, the buffer is preferably large enough such that the system control unit can always identify at least one ramp-up pulse before determining whether or not to apply a ramp-down pulse as a drive pulse.

Furthermore, it may be advantageous to provide a buffer large enough such that the system control unit can identify more than one of a particular type of non-firing pulse scheduled in the common drive waveform.

As an illustrative example, the buffer is preferably large enough such that the system control unit can identify at least two ramp-up pulses scheduled in a common drive waveform and may determine the most suitable ramp-up pulse from those scheduled in order to allow the residual pressure waves caused by the ramp-up pulse to dissipate/decay before a firing-pulse is applied.

Such functionality is depicted at FIG. 7*a*, whereby the first scheduled image data 92(*i*) in the buffer 62 requires a greyscale value of 3. Therefore, three drive pulses derived from the first scheduled pixel period of the common drive waveform are applied to the actuator element, such that three sub-droplets are ejected from a corresponding nozzle.

In FIG. 7*a*, the non-firing phase of the first pixel period comprises a single meniscus-vibration pulse which, in the present example, is not applied as a drive pulse because the system control unit may determine that it would not be beneficial for the actuator element to apply the meniscus-vibration pulse immediately after ejection of a droplet. Such a determination may be made based on, for example, rules provided as part of a program processed at the system control unit.

As scheduled image data 92(*ii*)-(*ix*) requires a greyscale value of 0, no firing pulses of the common drive waveform are applied as drive pulses during these pixel periods.

The system control unit may determine that it would be beneficial to power the actuator element down during this time to decrease or minimise the stress imparted on the actuator element, thereby potentially increasing the operational lifetime of the actuator element. Therefore, as the non-firing pulse of the second pixel period is a ramp-down pulse, it is applied as a drive pulse to the actuator element such that the actuator element is in a neutral state.

With the actuator element in a neutral state, the hold-low pulse of 102(*iii*) may be applied as a drive pulse if determined to be appropriate by the system control unit, whilst the hold-high pulse of 102(*iv*) is not applied as it may be harmful to the actuator element.

In FIG. 7*a*, the scheduled image data 92(*x*) requires a greyscale value of 2. Therefore, two sub-droplets are required to be ejected. Whilst there are two ramp-up pulses scheduled in the common drive waveform, (at 102(*vi*) & 102(*x*)), as the latter ramp-up pulse occurs after the required firing pulses and would be applied too late to have a beneficial effect, the non-firing pulse at 102(*vi*) is determined to be the most appropriate and is applied as a drive pulse to deform the actuator element such that it is in a deformed state and ready to print.

If a ramp-up pulse was not available between the scheduled image data 92(*i*) and 92(*x*), the system control unit, would, in an embodiment, determine it to be inappropriate to apply the ramp-down pulse at 102(*ii*) as it would not be possible to return to a deformed state before a drive pulse was applied.

Furthermore, if there was no scheduled image data in the buffer 62, the system control unit, would, in an embodiment, determine it to be inappropriate to apply the ramp-down pulse at 102(*ii*) as it may not be possible to return to a deformed state before a next drop ejection is required.

In an alternative example, if scheduled data 92(*x*)) had a greyscale level of 0, then the system control unit may determine it to be appropriate to maintain the actuator element in a neutral state beyond 102(*vi*). If, for example, scheduled image data having a greyscale value >1 immediately followed 92(*x*), then the ramp-up pulse at 102(*x*) could be applied as a drive pulse.

As above, a determination as to whether or not a particular non-firing pulse should be applied may be made by the system control unit based on data in storage including, but not limited to: the image data, the scheduled image data, the waveform-control signal, state data from the state machine, rules as defined by a program in storage and/or instructions received from a user.

The droplet deposition apparatus hereinbefore described is configured to generate a common drive waveform comprising a plurality of firing and non-firing pulses.

The non-firing pulses provide advantageous functionality for the droplet deposition apparatus, but may decrease the achievable pixel frequency. However, when a delay interval is required between consecutive firing phases for a particular application, then a firing phase having one or more non-firing pulses may be included in the delay interval without further increasing the pixel frequency when the duration of the non-firing pulse is less than or substantially equal to the delay interval.

Furthermore, instead of applying every non-firing pulse in the common drive waveform, the droplet deposition apparatus is configured to selectively apply non-firing pulses when determined to be appropriate.

Such functionality enables the droplet deposition apparatus to maximise the advantage provided by the common waveform by applying the firing pulses as drive pulses when required to create a pixel, but applying a non-firing pulse only when determined to be appropriate.

For example, only applying a ramp-down pulse to an actuator element when it is determined that a ramp-up pulse is scheduled in the common drive waveform before a next required drop-ejection means that printing performance of the actuator element is not affected, whilst the lifetime of the actuator element may be increased.

However, if it is determined that a ramp-up pulse is not scheduled in the common drive waveform before a next required drop-ejection, then the ramp-down pulse may not be applied, in which case print performance is not affected in that the actuator element will be capable of being driven to eject droplets, although the lifetime of the actuator element will be not be increased.

A firing phase may include one or more non-firing pulses e.g. provided between the firing-pulses in the same firing phase or after the last firing pulse in the same firing phase. Such functionality may be useful when the non-firing pulse is required more frequently than those non-firing pulses in the non-firing phase. For example, a cancellation pulse to dampen pressure waves in the pressure chamber may be provided in the firing phases for the duration of the common drive waveform, and may be applied as a drive pulse every time a firing pulse is applied as a drive pulse.

It should also be understood that the invention is not limited to non-firing phases having a single non-firing pulse, and that the non-firing phases may comprise two or more non-firing pulses.

In some embodiments, two or more common drive waveforms may be generated, whereby the characteristics of the non-firing phases of the different common drive waveforms differ from each other for each pixel period. For example, a first common drive waveform may comprise non-firing phases having a single ramp-up pulse; a second common drive waveform may comprise non-firing phases having a single ramp-down pulse; a third common drive waveform may comprise non-firing phases having a hold-low pulse etc.

Therefore, an appropriate non-firing pulse from one of the two or more common drive waveforms may be applied as a drive pulse. Such functionality requires an increase in head-control circuitry (e.g. increased no. of switches) but there would be no additional loss of time.

In some embodiments, the pixel periods may comprise zero non-firing pulses. For example, if the scheduled image data comprises ten consecutive pixels having greyscale values >0, then if determined (e.g. by the control circuitry) to be inappropriate to schedule a ramp-down pulse or a meniscus-vibration pulse, the common drive waveform which is generated may comprise pixel periods having firing phases without a non-firing phase.

Furthermore, whilst the examples above depict the pixel periods having a firing phase followed by a non-firing phase, the pixel periods may be configured such that the firing phase follows the non-firing phase.

The firing pulses of FIGS. 3*b*, 4, 6*a* and 7*a* are arranged such that an ejected sub-droplet has a higher velocity in comparison to a preceding sub-droplet when generated using drive pulses derived from the same firing phase.

By adjusting the timing between firing pulses and the relative velocities, these sub-droplets may merge in flight, thereby forming a single dot on the receiving medium at the desired location and having a particular greyscale value, e.g. between 0 and 3. The ejection of multiple sub-droplets to form a single dot having a particular greyscale level is well known and will not be explained here. For the purpose of describing the following embodiments and their examples, a greyscale level of 0, 1, 2, 3, . . . , n is intended to correspond to 0, 1, 2, 3, . . . , n ejected sub-droplets into the same pixel, where the volume of each sub-droplet contributes to the total volume landing in the pixel and therefore to the colour density of the resulting dot within the pixel.

Furthermore, whilst depicted as identical in the above referenced figures, the firing pulses may have different characteristics from one another. As above, it will be understood that the characteristics of any of the firing pulses described may be varied to change the ejection properties, such as the volume or velocity of the droplets, or sub-droplets. Such characteristics may include one or more of the amplitude (e.g. $V_{drive}$, $V_{rest}$), timing, duration or slew rates of the firing pulses.

The techniques described above are applicable to various types of droplet deposition apparatuses.

Where the term "comprising" is used in the present description and claims, it does not exclude other elements or steps and should not be interpreted as being restricted to the means listed thereafter. Where an indefinite or definite article is used when referring to a singular noun e.g. "a" or "an", "the", this includes a plural of that noun unless something else is specifically stated.

In a further alternative, the preferred embodiment of the present techniques may be realized in the form of a data carrier having functional data thereon, said functional data comprising functional computer data structures to, when loaded into a computer system or network and operated upon thereby, enable said computer system to perform all the steps of the method.

It will be clear to one skilled in the art that many improvements and modifications can be made to the foregoing exemplary embodiments without departing from the scope of the present techniques.

The disclosure describes a droplet deposition apparatus comprising: control circuitry configured to generate a common drive waveform; storage to store data, wherein the storage comprises a buffer to store scheduled image data relating to one or more pixels; a droplet deposition head having one or more actuator elements configured to be driven in response to drive pulses derived from the common drive waveform; and wherein the common drive waveform comprises a plurality of pixel periods comprising a firing phase and a non-firing phase, each firing phase comprising a firing pulse and each non-firing phase comprising a non-firing pulse, wherein the characteristics of each non-firing pulse are defined in response to the data in storage, wherein the firing pulse of a first pixel period is applied as a drive pulse to an actuator element based on the scheduled image data relating to a first pixel, and wherein the non-firing pulse of the first pixel period is applied as a drive pulse to the actuator element based on past image data and/or the stored scheduled image data.

In embodiments, the control circuitry comprises waveform generation circuitry configured to generate the common drive waveform in response to a waveform-control signal, wherein the control circuitry comprises a system control unit, the system control unit configured to generate the waveform-control signal in response to the data in storage.

In embodiments, the control circuitry comprises a state machine, configured to generate state data for the one or more actuator elements, wherein the control circuitry is configured to generate a pixel-control control signal in response to the data in storage, and wherein the data in storage comprises one or more of: the scheduled image data, the waveform-control signal, the state data, configurational data, a program and instructions received from a user.

In embodiments, the control circuitry is configured to generate the pixel-control signal in response to rules provided as part of the program or instructions received from a user.

In embodiments, the droplet deposition apparatus further comprises head-control circuitry configured to selectively apply the common drive waveform as one or more drive pulses to the one or more actuator elements in response to the pixel-control signal, wherein the head-control circuitry comprises switch-logic configured to selectively pass the common drive waveform therethrough to be applied as the one or more drive pulses dependent on a state of the switch-logic and wherein the head-control circuitry comprises a switch-logic-control unit configured to control the state of the switch-logic in response to the pixel-control signal. In embodiments the pixel-control signal may comprise a logic signal.

In embodiments, the common drive waveform may comprise two or more cycles of consecutive pixel periods, wherein the non-firing phases in the same cycle have different characteristics from one another.

In embodiments, the firing phases are substantially similar for the duration of the common drive waveform.

In embodiment, the characteristics of the non-firing pulses in the common drive waveform are dependent on the scheduled image data in the buffer, wherein the maximum interval between a first type of non-firing pulse and a second type of non-firing pulse in the common drive waveform is dependent on the scheduled image data in the buffer.

In embodiments, the at least one non-firing pulse is one or more of: a ramp-up pulse, a ramp-down pulse, a hold-low pulse, a hold-high pulse and a meniscus vibration pulse.

In embodiments, the common drive waveform may further comprise one or more pixel periods having zero non-firing pulses.

In embodiments, the non-firing pulses are applied independently of the at least one firing pulse.

In further embodiments, the firing phase comprises at least one non-firing pulse, such as a cancellation pulse or a meniscus vibration pulse.

The disclosure above additionally describes a method of driving one or more actuator elements of a droplet deposition apparatus, the method comprising: generating, using control circuitry, the common drive waveform, the common drive waveform comprising pixel periods having a firing phase comprising a firing pulse and a non-firing phase comprising a non-firing pulse, wherein the characteristics of each non-firing phase are defined in response to data in storage on the droplet deposition apparatus, the data in storage including past image data and/or scheduled image data relating to one or more pixels; for a first pixel: applying, using head control circuitry, a firing pulse of a first pixel period as a drive pulse to an actuator element based on scheduled image data in storage relating to the first pixel; applying, using the head control circuitry, a non-firing pulse of the first pixel period to the actuator element based on past image data and/or the scheduled image data.

In embodiments, the data in storage may comprise one or more of: scheduled image data, a waveform-control signal, state data, configurational data, a program and instructions received from a user.

The disclosure above additionally describes circuitry for a droplet deposition apparatus comprising a droplet deposition head having one or more actuator elements configured to be driven in response to drive pulses derived from a common drive waveform, the circuitry comprising: storage circuitry, configured to store scheduled image data relating to one or more pixels; processing circuitry configured to generate a waveform-control signal in response to the scheduled image data and/or further data in the storage; waveform generation circuitry configured to generate a common drive waveform in response to the waveform-control signal, the common drive waveform comprising a plurality of pixel periods having a firing phase and a non-firing phase, each firing phase comprising a firing pulse and each non-firing phase comprising a non-firing pulse, wherein the characteristics of each non-firing phase are defined by the waveform-control signal; head-control circuitry configured to apply the firing pulse of a first pixel period as a drive pulse to an actuator element based on the scheduled image data relating to a first pixel; and wherein the head-control circuitry is further configured to apply the non-firing pulse of the first pixel period as a drive pulse to the actuator element based on past image data and/or the scheduled image data.

In embodiments, the circuitry may be further configured to generate a pixel-control signal in response to the first data and/or the further data in the storage and may further comprise head-control circuitry configured to selectively apply the non-firing pulses as drive pulses to the one or more actuator elements in response to the pixel-control signal.

The disclosure further describes a droplet deposition apparatus comprising: control circuitry configured to generate a common drive waveform; a droplet deposition head having one or more actuator elements configured to be driven in response to drive pulses derived from the common drive waveform; and wherein the common drive waveform comprises a plurality of pixel periods, the pixel periods comprising a firing phase and a non-firing phase, each firing phase comprising at least one firing pulse and each non-firing phase comprising at least one non-firing pulse, wherein the characteristics of each non-firing pulse are defined in response to data in storage on the droplet deposition apparatus, and wherein the firing or non-firing pulses are selectively applied as drive pulses to the one or more actuator elements in response to the data in storage.

The disclosure above further describes a method of driving one or more actuator elements of a droplet deposition apparatus in response to drive pulses derived from a common drive waveform, the method comprising: generating, using control circuitry, the common drive waveform, the common drive waveform comprising consecutive pixel periods, the pixel periods having a firing phase comprising a firing pulse and a non-firing phase comprising a non-firing pulse, wherein the characteristics of each non-firing phase are defined in response to data in storage on the droplet deposition apparatus; generating, using the control circuitry, a pixel-control signal in response to the data in storage; selectively applying, using head-control circuitry, the firing or non-firing pulses as drive pulses to the one or more actuator elements in response to the pixel-control signal.

The disclosure further describes circuitry for a droplet deposition apparatus comprising a droplet deposition head having one or more actuator elements configured to be driven in response to drive pulses derived from a common drive waveform, the circuitry comprising: communication circuitry for receiving first data from one or more external sources; storage circuitry, configured to store the first data therein; processing circuitry configured to generate a waveform-control signal in response to the first data and/or further data in the storage; and waveform generation circuitry configured to generate a common drive waveform in response to the waveform-control signal, the common drive waveform comprising consecutive pixel periods, the pixel periods having a firing phase and a non-firing phase wherein the characteristics of each non-firing phase are defined by waveform-control signal.

The invention claimed is:

1. An apparatus to generate a common drive waveform for driving one or more actuators of a droplet deposition head, the apparatus comprising:

a storage to store data, wherein the storage is configured to store at least scheduled image data relating to one or more pixels;

processing circuitry configured to generate a waveform-control signal in response to the scheduled image data and/or further data in the storage;

a waveform generator configured to generate the common drive waveform in response to the waveform-control signal;

wherein the common drive waveform comprises a plurality of pixel periods, each comprising a firing phase and one or more non-firing phases, each firing phase comprising a firing pulse and each one or more non-firing phase comprising one or more non-firing pulses, wherein within the plurality of pixel periods, one or more of the non-firing phases comprise a first type of non-firing pulse and a second type of non-firing pulse, wherein the characteristics of each type of non-firing pulse are defined in response to the data stored in the storage, and the first type of non-firing pulse is associated with first characteristics and the second type of non-firing pulse is associated with second characteristics different from the first characteristics; and wherein a maximum interval between the first type of non-firing pulse and the second type of non-firing pulse in the common drive waveform is dependent on the scheduled image data.

2. The apparatus according to claim 1, wherein the processing circuitry comprises a state machine configured to generate state data for the one or more actuators.

3. The apparatus according to claim 1, wherein the processing circuitry is configured to generate a pixel-control signal in response to the data in the storage.

4. The apparatus according to claim 3, further comprising a head-control circuitry configured to selectively apply the common drive waveform as one or more drive pulses to the one or more actuators in response to the pixel-control signal.

5. The apparatus according to claim 4, wherein the head-control circuitry comprises switch-logic configured to selectively pass the common drive waveform therethrough to be applied as the one or more drive pulses dependent on a state of the switch-logic.

6. The apparatus according to claim 3, wherein a head-control circuitry comprises a switch-logic-control unit configured to control a state of switch-logic in response to the pixel-control signal.

7. The apparatus according to claim 1, wherein the data in the storage further comprises one or more of: the waveform-control signal, state data, configurational data, a program and instructions received from a user.

8. The apparatus according to claim 7, wherein the processing circuitry is configured to generate a pixel-control signal in response to rules provided as part of the program or instructions received from a user.

9. The apparatus according to claim 1, wherein the common drive waveform comprises two or more cycles of consecutive pixel periods; and wherein the non-firing phases in the same cycle have different characteristics from one another.

10. The apparatus according to claim 1, wherein the firing phases are substantially similar for the duration of the common drive waveform.

11. The apparatus according to claim 1, wherein at least one of the first type of non-firing pulse or the second type of non-firing pulse comprises one or more of: a ramp-up pulse, a ramp-down pulse, a hold-low pulse, a hold-high pulse, or a meniscus vibration pulse.

12. The apparatus according to claim 1, wherein each firing phase comprises a non-firing pulse.

13. The apparatus according to claim 12, wherein the non-firing pulse in each firing phase comprises a cancellation pulse.

14. The apparatus according to claim 1, wherein the common drive waveform further comprises one or more pixel periods having zero non-firing pulses.

15. The apparatus according to claim 1, wherein the non-firing pulses are applied independently of the at least one firing pulse.

16. The apparatus according to claim 1, further comprising a head-control circuitry configured to apply the firing pulse of a first pixel period as a drive pulse to an actuator based on the scheduled image data relating to a first pixel.

17. The apparatus according to claim 16, wherein the head-control circuitry is further configured to apply a non-firing pulse of the first pixel period as a drive pulse to the actuator element based on past image data and/or the scheduled image data.

18. The apparatus according to claim 1, wherein:

the storage comprises a buffer; and the maximum interval is defined based on a size of the buffer.

19. A method of driving one or more actuator elements of a droplet deposition apparatus, the method comprising:

generating a common drive waveform, the common drive waveform comprising a plurality of pixel periods, each comprising a firing phase comprising a firing pulse and one or more a non-firing phase comprising one or more non-firing pulses, wherein within the plurality of pixel periods, one or more of the non-firing phases comprise a first type of non-firing pulse and a second type of non-firing pulse, wherein the characteristics of each type of non-firing pulse are defined in response to data stored in storage on the droplet deposition apparatus, and the first type of non-firing pulse is associated with first characteristics and the second type of non-firing pulse is associated with second characteristics different from the first characteristics, the data in the storage comprising past image data and/or scheduled image data relating to one or more pixels;

wherein a maximum interval between the first type of non-firing pulse and the second type of non-firing pulse in the common drive waveform is dependent on scheduled image data; and for a first pixel:

applying, a firing pulse of a first pixel period as a drive pulse to an actuator element based on the scheduled image data in the storage relating to the first pixel;

applying, a non-firing pulse of the first pixel period to the actuator element based on the past image data and/or the scheduled image data.

20. A computer program product for instructing a computer to perform a method of driving one or more actuator elements of a droplet deposition apparatus comprising, the method comprising:

generating a common drive waveform, the common drive waveform comprising a plurality of pixel periods, each comprising a firing phase comprising a firing pulse and one or more a non-firing phases comprising one or more non-firing pulses, wherein within the plurality of pixel periods, one or more of the non-firing phases comprise a first type of non-firing pulse and a second type of non-firing pulse, wherein the characteristics of each type of non-firing pulse are defined in response to data stored in storage on the droplet deposition apparatus, and the first type of non-firing pulse is associated with first characteristics and the second type of non-firing pulse is associated with second characteristics different from the first characteristics, the data in the storage comprising past image data and/or scheduled image data relating to one or more pixels;

wherein a maximum interval between the first type of non-firing pulse and the second type of non-firing pulse in the common drive waveform is dependent on the scheduled image data; and for a first pixel:

applying, a firing pulse of a first pixel period as a drive pulse to an actuator element based on the scheduled image data in the storage relating to the first pixel;

applying, a non-firing pulse of the first pixel period to the actuator element based on the past image data and/or the scheduled image data.

* * * * *